US008550839B2

(12) United States Patent
Fabian et al.

(10) Patent No.: US 8,550,839 B2
(45) Date of Patent: Oct. 8, 2013

(54) CABLE CLAMP FOR CABLE CONNECTOR

(75) Inventors: David James Fabian, Mount Joy, PA (US); Thomas Dean Ratzlaff, Menlo Park, CA (US); Paul Craig Tally, Santa Clara, CA (US); William H. Bernhart, Elizabethtown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 175 days.

(21) Appl. No.: 13/092,014

(22) Filed: Apr. 21, 2011

(65) Prior Publication Data

US 2012/0270434 A1 Oct. 25, 2012

(51) Int. Cl.
*H01R 13/58* (2006.01)

(52) U.S. Cl.
USPC ..... 439/460; 439/701

(58) Field of Classification Search
USPC ..... 439/460, 701
See application file for complete search history.

(56) References Cited

U.S. PATENT DOCUMENTS

| | | | | |
|---|---|---|---|---|
| 3,977,755 | A * | 8/1976 | Edel et al. | 439/607.47 |
| 4,343,528 | A | 8/1982 | Lucius et al. | |
| 4,749,369 | A * | 6/1988 | Wang | 439/460 |
| 4,824,383 | A * | 4/1989 | Lemke | 439/660 |
| 4,838,808 | A * | 6/1989 | Fujiura | 439/352 |
| 4,921,441 | A * | 5/1990 | Sauder | 439/460 |
| 5,195,909 | A * | 3/1993 | Huss et al. | 439/465 |
| 5,391,092 | A | 2/1995 | Sumida | |
| 6,165,017 | A * | 12/2000 | Kuo | 439/607.45 |
| 6,231,392 | B1 * | 5/2001 | van Woensel | 439/607.44 |
| 2010/0081344 | A1 | 4/2010 | Gleissner et al. | |

FOREIGN PATENT DOCUMENTS

| | | |
|---|---|---|
| EP | 0 907 221 A2 | 4/1999 |
| EP | 2 105 996 A1 | 9/2009 |
| WO | 2008071917 A1 | 6/2008 |

OTHER PUBLICATIONS

International Search Report, International Application No. PCT/US2012/033856, International Filing Date Apr. 17, 2012.

* cited by examiner

*Primary Examiner* — Briggitte R Hammond

(57) ABSTRACT

A cable connector includes a cable clamp having a cable end and a mating end. The cable clamp has an upper housing and a lower housing joined to the upper housing. An aperture is formed in at least one of the upper housing or the lower housing. The upper housing and the lower housing are moveable between a pre-assembled position and an assembled position. An insert is provided having a wire end and a mating end. The insert has a tab configured to engage the aperture to secure the insert within the mating end of the cable clamp in the pre-assembled position. The upper housing and the lower housing are moveable to the assembled position to retain the insert within the mating end of the cable clamp and a cable within the cable end of the cable clamp.

20 Claims, 5 Drawing Sheets

CABLE CLAMP FOR CABLE CONNECTOR

BACKGROUND OF THE INVENTION

The subject matter described herein relates to cable connectors and, more particularly, to a cable clamp for a cable connector.

Cable connectors generally include contacts that are coupled to wires of a cable. The cable directs electrical signals through the wires to the contacts. The contacts engage corresponding contacts of a mating connector to electrically couple the cable and the mating connector. The electrical signals from the cable are passed via the contacts of the cable connector to the mating connector. The cable connector and the mating connector may be used to electrically couple various electronic devices and/or electronic components.

Often the cable connector includes an insert positioned within a cable clamp. The insert is configured with contacts. The wires of the cable are joined to the insert to electrically couple the cable and the contacts provided in the insert. The insert may be housed in a cable clamp. The cable clamp provides strain relief for the wires thereby preventing damage to the wires so that electrical coupling is maintained.

However, conventional cable connectors are not without their disadvantages. Generally, the wires of the cable are joined to the insert prior to the cable clamp being secured to the insert and cable. When several inserts are being used in the cable connector, the assembly of the connector may become complicated because the inserts cannot be secured to the cable clamp until each insert is wired. In particular, the inserts and the wires must be maintained while other inserts are joined to the wires of the cable. Often, one of the inserts may become disconnected from the cable clamp while other inserts are being wired. Moreover, the inserts and the cable must be aligned within the cable clamp to secure the cable clamp thereon. If one of the inserts and/or the cable becomes misaligned the cable clamp will not properly secure the inserts and cable within the connector. Accordingly, assembly of the cable connector may be difficult and time consuming.

A need remains for a cable connector that secures the inserts during assembly of the connector. During manufacturing, a need also remains for strain relief of the wires prior to installation of the insert into the connector shell. Additionally, in some assembly processes inserts are installed through small conduit prior to final installation into the connector shell.

SUMMARY OF THE INVENTION

In one embodiment, a connector for a cable is provided. The connector includes a cable clamp having a cable end and a mating end. The cable end is configured to secure a cable. The cable clamp has an upper housing and a lower housing joined to the upper housing. An aperture is formed in at least one of the upper housing or the lower housing. The upper housing and the lower housing are moveable between a pre-assembled position and an assembled position. An insert is provided having a wire end and a mating end. The wire end is configured to join to wires of the cable and the mating end is configured to engage another connector. The insert has a tab configured to engage the aperture to secure the insert within the mating end of the cable clamp in the pre-assembled position. The upper housing and the lower housing are moveable to the assembled position to retain the insert within the mating end of the cable clamp and the cable within the cable end of the cable clamp.

In another embodiment, a connector for a cable is provided. The connector includes a cable clamp having a cable end and a mating end. The cable end is configured to secure a cable. The cable clamp has an upper housing and a lower housing joined to the upper housing. The upper housing and the lower housing are moveable between a pre-assembled position and an assembled position. An insert is provided having a wire end and a mating end. The wire end is configured to join to wires of the cable and the mating end is configured to engage another connector. The insert has a coupling mechanism configured to engage at least one of the upper housing or the lower housing to secure the insert within the mating end of the cable clamp in the pre-assembled position. The upper housing and the lower housing are moveable to the assembled position to retain the insert within the mating end of the cable clamp and the cable within the cable end of the cable clamp. A latching mechanism is formed on one of the upper housing or the lower housing and an engagement mechanism is formed on the other of the upper housing and the lower housing. The latching mechanism has a first latch and a second latch. The engagement mechanism engages the first latch in the pre-assembled position and the engagement mechanism engages the second latch in the assembled position.

In another embodiment, a connector for a cable is provided. The connector includes a cable clamp having a cable end and a mating end. The cable end is configured to secure a cable. The cable clamp has an upper housing and a lower housing joined to the upper housing. The upper housing and the lower housing are moveable between a pre-assembled position and an assembled position. A latching mechanism is formed on one of the upper housing or the lower housing and an engagement mechanism is formed on the other of the upper housing and the lower housing. The latching mechanism has a first latch and a second latch. The engagement mechanism engages the first latch in the pre-assembled position and the engagement mechanism engages the second latch in the assembled position. An insert is provided having a wire end and a mating end. The wire end of the insert is positioned within the cable clamp and the mating end of the insert extends from the cable clamp.

DETAILED DESCRIPTION OF THE INVENTION

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
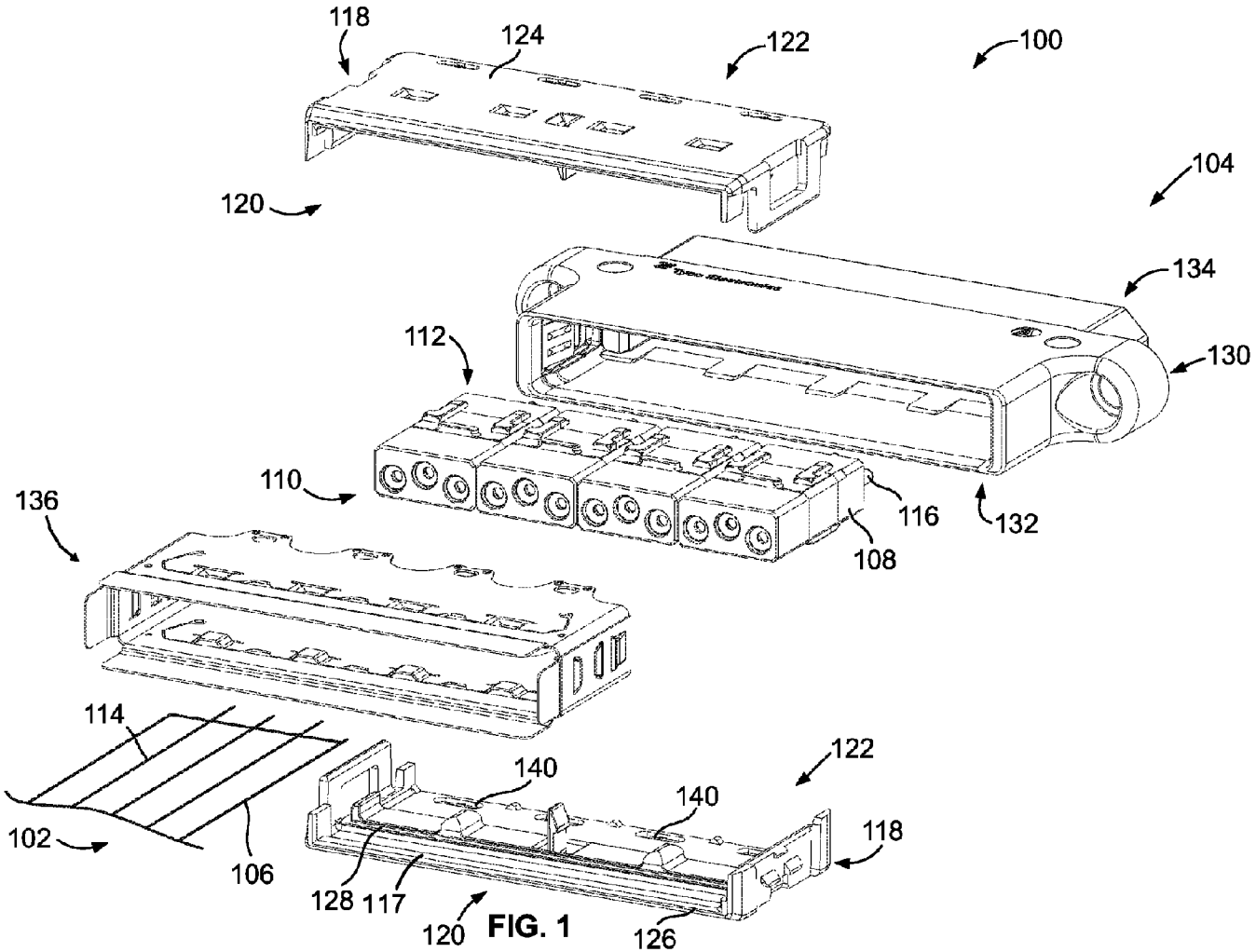
FIG. 1 is an exploded view of a cable connector formed in accordance with an embodiment.

FIG. 1 illustrates an exploded view of a cable connector 100. The cable connector 100 includes a cable end 102 and a mating end 104. The cable end 102 of the connector 100 is configured to join to a cable 106. The cable 106 conveys electrical signals therethrough. The electrical signals may be data signals, power signals, optical signals, or the like. The mating end 104 of the connector 100 is configured to couple to a corresponding mating connector (not shown). The connector 100 directs the electrical signals from the cable 106 to the mating connector.

The cable connector 100 includes modular inserts 108 having a wire end 110 and a mating end 112. The connector 100 may include any number of inserts 108. Contacts 116 are installed onto the wires 114 in a manner that provides electrical coupling. Inserts 108 are configured to receive contacts 116. The inserts 108 may include any configuration of contacts 116. The contacts 116 are configured to engage corresponding contacts (not shown) of the mating connector. The inserts 108 are modular so that the inserts 108 may be replaced with other inserts 108 having different contact configurations. Replacing the inserts 108 enables the connector 100 to be configured for various different mating connectors. The electrical signals from the cable 106 are directed through the inserts 108 to the mating connector when the connector 100 is coupled to the mating connector. Electrical signals may also be directed from the mating connector to the cable 106 via the inserts 108.

A cable clamp housing 118 is configured to retain the inserts 108. The cable clamp housing 118 includes a cable end 120 and a mating end 122. The cable end 120 of the cable clamp housing 118 is configured to receive the cable 106. The cable end 120 of the cable clamp housing 118 secures the cable 106 within the connector 100. The mating end 122 of the cable clamp housing 118 is configured to retain the inserts 108. The wire end 110 of each insert 108 is retained within the mating end 122 of the cable clamp housing 118. The mating end 112 of each insert 108 extends from the mating end 122 of the cable clamp housing 118. The contacts 116 extend from the mating end 122 of the cable clamp housing 118. In another embodiment, the inserts 108 may be positioned entirely within the cable clamp housing 118.

The cable clamp housing 118 includes an upper housing 124 and a lower housing 126. The upper housing 124 couples to the lower housing 126 so that the cable 106 is retained within the cable clamp housing 118 by means of compliant cushion 117. The lower housing 126 includes a retention flange 128. The upper housing 124 includes a corresponding retention flange (not shown). The retention flange 128 of the lower housing 126 is aligned with the retention flange of the upper housing 124 when the upper housing 124 is coupled to the lower housing 126. The cable 106 is configured to be positioned between the retention flange 128 of the lower housing 126 and the retention flange of the upper housing to secure the cable 106 within the cable clamp housing 118. The upper housing 124 also couples to the lower housing 126 so that the inserts 108 are retained within the cable clamp housing 118. The flange 128 provides positioning for the cables and mechanical strength in this embodiment.

A shell 130 is provided having a cable end 132 and mating end 134. The cable end 132 is configured to receive the cable clamp housing 118 therein. The cable clamp housing 118 is positioned so that the contacts 116 of each insert 108 extend toward the mating end 134 of the shell 130. In one embodiment, the contacts 116 of each insert 108 extend from the mating end 134 of the shell 130. The mating end 134 of the shell 130 is configured to couple to the mating connector. The cable 106 is configured to extend from the cable end 132 of the shell 130. A backshell 136 is positioned over the cable 106 and the cable clamp housing 118. The backshell 136 provides mechanical constraint such that the cable clamp housing 118 may not be disassembled without first removing the backshell 136. The backshell 136 is positioned within the cable end 132 of the shell 130. Cable clamps 118 may be constructed as hermaphroditic components as shown or as two discrete components.

Figure 2:
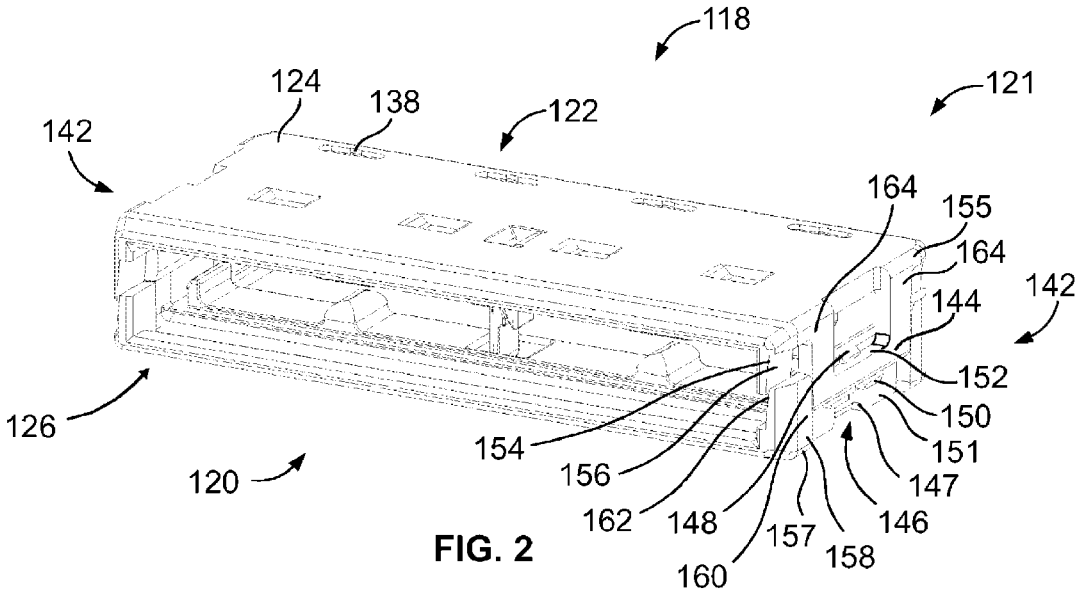
FIG. 2 is a front perspective view of the cable clamp shown in FIG. 1 in a pre-assembled position.

FIG. 2 is a side perspective view of the cable clamp housing 118 in a pre-assembled position 121. The upper housing 124 includes apertures 138 at the mating end 122 of the cable clamp housing 118. The apertures 138 are positioned along the upper housing 124. The apertures 138 are configured to retain an insert 108 within the cable clamp housing 118. The lower housing 126 includes apertures 140 (shown in FIG. 1) at the mating end 122 of the cable clamp housing 118. The apertures 140 are positioned along the lower housing 126. The apertures 140 are configured to retain an insert 108 within the cable clamp housing 118. In one embodiment, the cable clamp housing 118 only includes the apertures 138 of the upper housing 124 or the apertures 140 of the lower housing 126. The apertures 138 and 140 are formed as slots. Alternatively, the apertures 138 and 140 may have any suitable shape for receiving a corresponding mechanism of the insert 108.

The cable clamp housing 118 includes sides 142 extending between the mating end 122 and the cable end 120. The upper housing 124 includes sides 155 and the lower housing 126 includes sides 157. The sides 155 and 157 of the upper housing 124 and lower housing 126, respectively, form the sides 142 of the cable clamp housing 118. The upper housing 124 includes an engagement mechanism 144 positioned on each side 155 of the upper housing 124. The engagement mechanism 144 includes an outer surface 164 that extends along the side 155 of the upper housing 124. The lower housing 126 includes a latching mechanism 146 positioned on each side 157 of the lower housing 126. The latching mechanism 146 includes a latching surface 147 that is recessed with respect to the side 157 of the lower housing 126. The engagement mechanism 144 is aligned with the latching mechanism 146. The engagement mechanism 144 is configured to be received within the latching mechanism 146. In one embodiment, the cable clamp housing 118 may include any number of corresponding engagement mechanisms 144 and latching mechanisms 146. In one embodiment, the engagement mechanism 144 and the latching mechanism 146 may include any configuration of latches.

In the illustrated embodiment, the latching mechanism 146 includes a first latch 148 and a second latch 150 extending from the latching surface 147. A first recess 149 (shown in FIG. 3) is formed between the first latch 148 and the second latch 150 and a second recess 151 is formed below the second latch 150. The engagement mechanism 144 includes a crossbar 152. The crossbar 152 is configured to engage the first latch 148 and the second latch 150. In the pre-assembled position 121, the crossbar 152 of the engagement mechanism 144 engages the first latch 148 of the latching mechanism 146. In the pre-assembled position 121, the crossbar 152 of the engagement mechanism 144 is positioned within the first recess 149 between the first latch 148 and the second latch 150 of the latching mechanism 146 to space the upper housing 124 from the lower housing 126. In the pre-assembled position 121, the upper housing 124 and the lower housing 126 are spaced so that wires 114 may be properly positioned (commonly referred to as "dressed") between compliant cushions 117 prior to final assembly of the cable clamp housing 118.

The upper housing 124 includes inner flanges 154 positioned adjacent to the engagement mechanism 144. The inner flanges 154 are recessed with respect to the side 155 of the upper housing 124. The inner flanges 154 include a mating surface 156 that is recessed with respect to the side 155 of the upper housing 124. The lower housing 126 includes outer flanges 158 positioned adjacent to the latching mechanism 146. The side 157 of the lower housing 126 forms an outer surface 160 of each outer flange 158. The outer flanges 158 include a mating surface 162 opposite the outer surface 160. The outer flanges 158 are aligned with the inner flanges 154 in the pre-assembled position 121. The outer surface 160 of each outer flange 158 is substantially flush with the outer surface 164 of the engagement mechanism 144. A portion of the mating surface 162 of each outer flange 158 abuts a portion of the mating surface 156 of the inner flanges 154.

Figure 3:
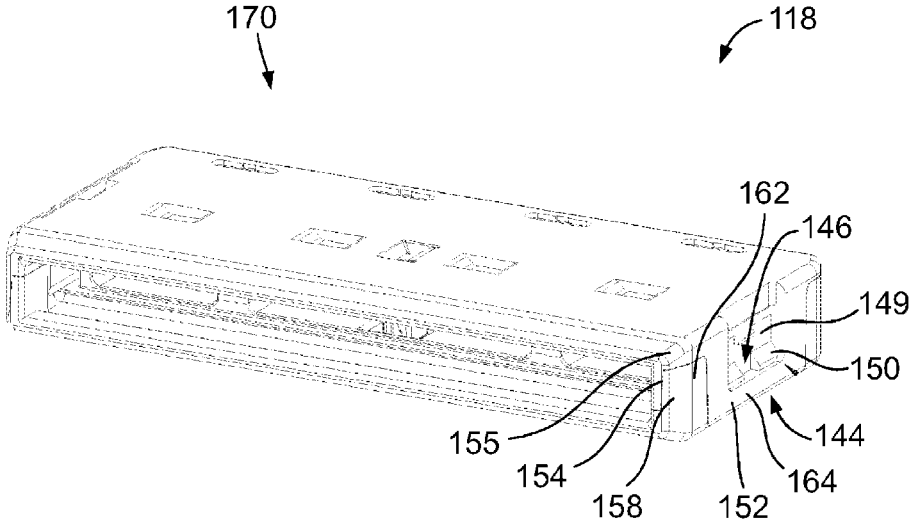
FIG. 3 is a front perspective view of the cable clamp shown in FIG. 1 in an assembled position.

FIG. 3 illustrates the cable clamp housing 118 in an assembled position 170. In the assembled position 170, the crossbar 152 of the engagement mechanism 144 engages the second latch 150 of the latching mechanism 146. In the assembled position 170, the crossbar 152 is positioned in the second recess 151 (shown in FIG. 2). When the cable clamp housing 118 is moved from the pre-assembled position 121 to the assembled position 170, the mating surface 156 of the inner flanges 154 slide along the mating surface 162 of the corresponding outer flanges 158. In the assembled position 170, the inner flanges 154 abut the outer flanges 158. The mating surface 156 of each inner flange 154 abuts the mating surface 162 of each corresponding outer flange 158. The outer surface 160 of each outer flange 158 is positioned substantially flush with the side 155 of the upper housing 124 and the outer surface 164 of the engagement mechanism 144. In the assembled position, the cable clamp housing 118 is configured to retain the inserts 108 therein.

It should be noted that in one embodiment, the engagement mechanism 144 may be formed in the lower housing 126 and the latching mechanism 146 may be formed in the upper housing 124. Moreover, the inner flange 154 may be formed in the lower housing 126 and the outer flange 158 may be formed in the upper housing 126.

Figure 4:
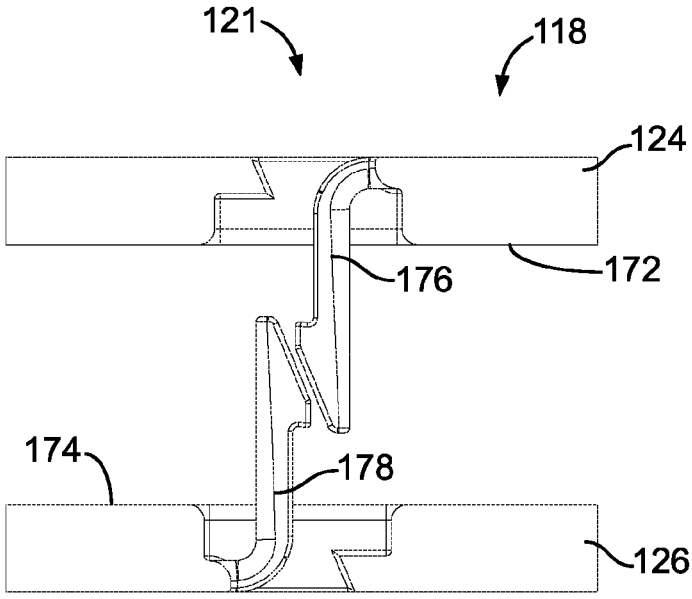
FIG. 4 is a front view of a section of the cable clamp shown in FIG. 1 in the pre-assembled position.

FIG. 4 is a front view of the cable clamp housing 118 in the pre-assembled position 121. The upper housing 124 includes an inner surface 172 and the lower housing 126 includes an inner surface 174. The inner surface 172 of the upper housing 124 faces the inner surface 174 of the lower housing 126. The upper housing 124 includes a latch 176. The latch 176 extends from the inner surface 172 of the upper housing 124 toward the inner surface 174 of the lower housing 126. The latch 176 is substantially centered between the sides 155 of the upper housing 124. Alternatively, the latch 176 may be positioned at any intermediate location between the sides 155 of the upper housing 124. In one embodiment, the upper housing 124 may include any number of latches 176 positioned between the sides 155 of the upper housing 124.

The lower housing 126 includes a latch 178 extending from the inner surface 174 of the lower housing 126. The latch 178 extends toward the inner surface 172 of the upper housing 124. The latch 178 is substantially centered between the sides 157 of the lower housing 126. Alternatively, the latch 178 may be positioned at any intermediate location between the sides 157 of the lower housing 126. In one embodiment, the lower housing 126 may include any number of latches 178 to correspond to multiple latches 176 extending from the upper housing 124. The latch 178 is aligned with the latch 176. In an embodiment having multiple latches 176 and 178, each latch 178 is aligned with a latch 176.

Figure 5:
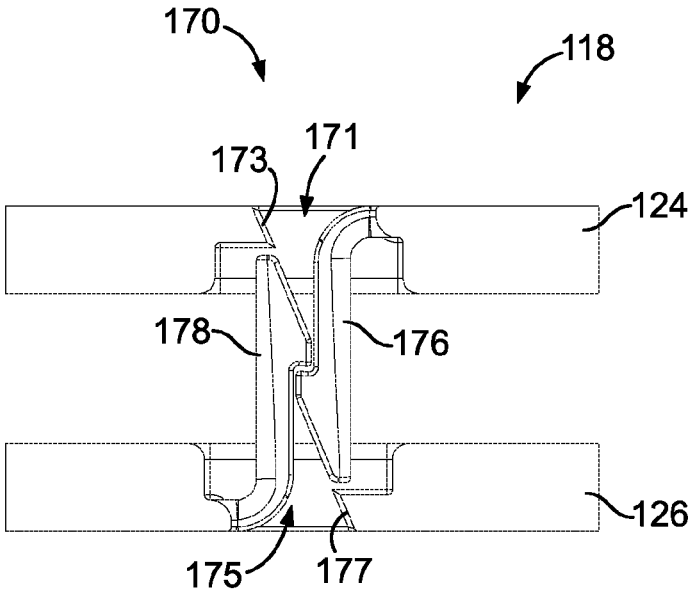
FIG. 5 is a front view of a section of the cable clamp shown in FIG. 1 in the assembled position.

FIG. 5 is a front cross-sectional view of the cable clamp housing 118 in the assembled position 170. In the assembled position 170, the latch 176 of the upper housing 124 engages the latch 178 of the lower housing 126. The latches 176 and 178 engage one another to provide support to the cable clamp housing 118. The latches 176 and 178 provide support along a length of the cable clamp housing 118 between the sides 142 of the cable clamp housing 118. In one embodiment, the latches 176 and 178 may be formed as any corresponding coupling mechanisms that join the upper housing 124 and the lower housing 126.

The upper housing 124 includes an opening 171 extending therethrough. The opening 171 is positioned adjacent to the latch 176. The opening 171 include an angled side 173 that flares outward from the inner surface 172 of the upper housing 124. The latch 176 is accessible with a tool through the opening 171. The latch 176 is capable of being disengaged from the latch 178 with a tool extended through the opening 171. The latch 176 may be disengaged from the latch 178 to separate the upper housing 124 and the lower housing 126.

The lower housing 126 also includes an opening 175 that extends therethrough. The opening 175 is positioned adjacent to the latch 178. The opening 175 include a side 177 that is angled with respect to the inner surface 174 of the lower housing 126. The latch 178 is accessible through the opening 175. The latch 178 is capable of being disengaged from the latch 176 with a tool that is inserted through the opening 175. The latch 178 is disengaged from the latch 176 to separate the lower housing 126 from the upper housing 124. In one embodiment, a tool need only be inserted through one of the openings 171 or 175 to disengage the latch 176 and the latch 178.

Figure 6:
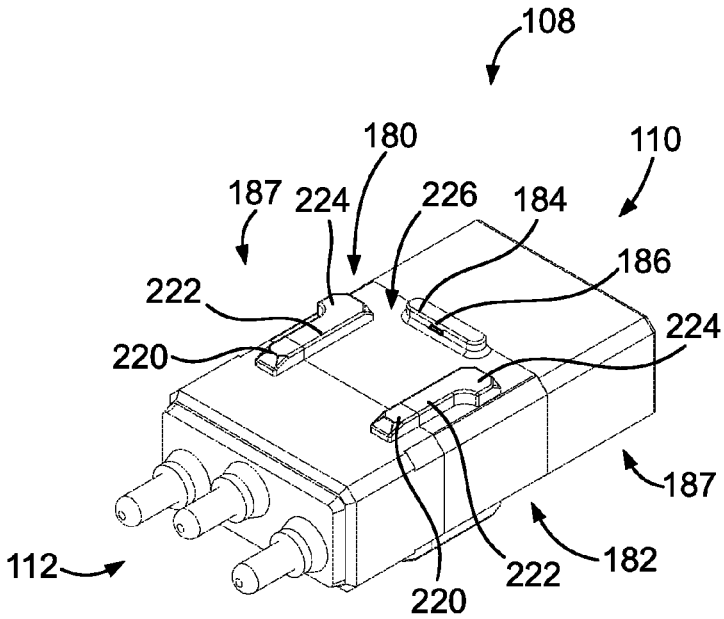
FIG. 6 is a top perspective view of an insert shown in FIG. 1.

FIG. 6 is a top perspective view of an insert 108. The insert 108 includes a top 180 and a bottom 182 extending between the wire end 110 and a mating end 112 of the insert 108. A coupling mechanism 184 is positioned on the top 180 of the insert 108. In the illustrated embodiment, the coupling mechanism 184 is formed as a tab. The coupling mechanism 184 is positioned proximate to the wire end 110 of the insert 108. In one embodiment, the coupling mechanism 184 may be positioned at any location between the wire end 110 and the mating end 112 of the insert 108. The coupling mechanism 184 is centered between sides 187 of the insert 108. Alternatively, the coupling mechanism 184 may be positioned at any intermediate location between the sides 187 of the insert 108. In one embodiment, the insert 108 includes multiple coupling mechanisms 184 extending from the top 180 of the insert 108.

The coupling mechanism 184 is configured to engage the upper housing 124 of the cable clamp housing 118. In one embodiment, the coupling mechanism 184 is configured to be received in one of the apertures 138 formed in the upper housing 124. The coupling mechanism 184 includes a flange 186 extending therefrom. The flange 186 extends toward the mating end 112 of the insert 108. In one embodiment, the flange 186 may extend toward the wire end 110 of the insert 108. In another embodiment, the coupling mechanism 184 may include a flange 186 extending toward the mating end 112 of the insert 108 and a flange 186 extend toward the wire end 110 of the insert 108. The flange 186 is configured to engage the upper housing 124 to secure the insert 108 within the cable clamp housing 118.

Ribs 220 are positioned on the top 180 of the insert 108. The ribs 220 are positioned proximate to the sides 187 of the insert 108. The ribs 220 include a first portion 222 that extends from the mating end 112 of the insert 108. A second portion 224 of each rib 220 extends toward a side 187 of the insert 108. An engagement surface 226 is formed between the second portion 224 of each rib 220 and the coupling mechanism 184. The engagement surface 226 extends between the sides 187 of the insert 108.

Figure 7:
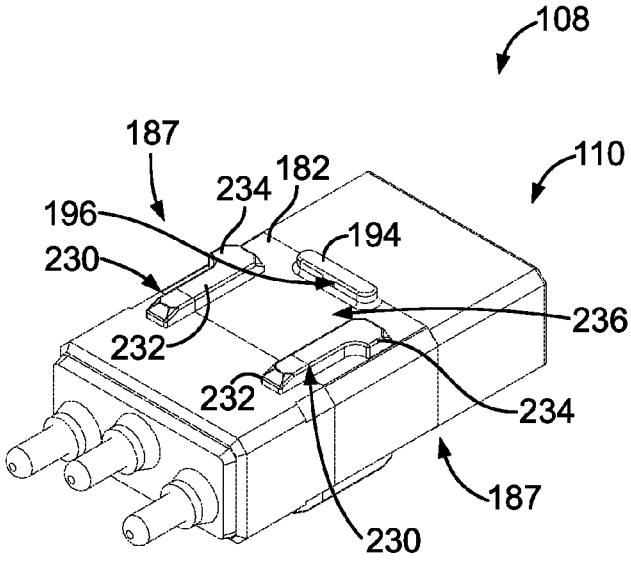
FIG. 7 is a bottom perspective view of an insert shown in FIG. 1.

FIG. 7 is a bottom perspective view of the insert 108. A coupling mechanism 194 is positioned on the bottom 182 of the insert 108. In the illustrated embodiment, the coupling mechanism 194 is formed as a tab. The coupling mechanism 194 is positioned proximate to the wire end 110 of the insert 108. In one embodiment, the coupling mechanism 194 may be positioned at any location between the wire end 110 and the mating end 112 of the insert 108. The coupling mechanism 194 is centered between the sides 187 of the insert 108. Alternatively, the coupling mechanism 194 may be positioned at any intermediate location between the sides 187 of the insert 108. In one embodiment, the insert 108 includes multiple coupling mechanisms 194 extending from the bottom 182 of the insert 108.

The coupling mechanism 194 is configured to engage the lower housing 126 of the cable clamp housing 118. In one embodiment, the coupling mechanism 194 is configured to be received in one of the apertures 140 formed in the lower housing 126. The coupling mechanism 194 includes a flange 196 extending therefrom. The flange 196 extends toward the mating end 112 of the insert 108. In one embodiment, the flange 196 may extend toward the wire end 110 of the insert 108. In another embodiment, the coupling mechanism 194 may include a flange 196 extending toward the mating end 112 of the insert 108 and a flange 196 extend toward the wire end 110 of the insert 108. The flange 196 is configured to engage the lower housing 126 to secure the insert 108 within the cable clamp housing 118.

Ribs 230 are positioned on the bottom 182 of the insert 108. The ribs 230 are positioned proximate to the sides 187 of the insert 108. The ribs 230 include a first portion 232 that extends from the mating end 112 of the insert 108. A second portion 234 of each rib 230 extends toward a side 187 of the insert 108. An engagement surface 236 is formed between the second portion 234 of each rib 230 and the coupling mechanism 184. The engagement surface 236 extends between the sides 187 of the insert 108. In one embodiment, the ribs 230 may be combined into a single rib that extends across the entire surface of the inserts.

In the pre-assembled position 121, the coupling mechanism 194 is secured to the lower housing 126. The coupling mechanism 194 retains the insert 108 within the cable clamp housing 118 while other inserts 108 are positioned within the cable clamp housing 118. Alternatively, the coupling mechanism 184 may be secured to the upper housing 124 in the pre-assembled position 121 to retain the insert 108. When the cable clamp housing 118 is moved to the assembled position 170 both the top 180 and the bottom 182 of the insert are secured within the cable clamp housing 118. In the assembled position 170, the coupling mechanism 184 is secured within the aperture 138 of the upper housing 124 and the coupling mechanism 194 is secured within the aperture 140 of the lower housing 126.

Figure 8:
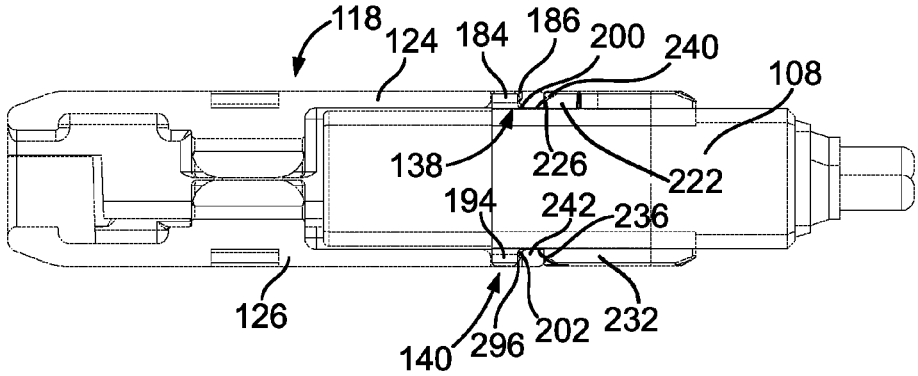
FIG. 8 is a cross-sectional view of the insert shown in FIG. 1 positioned within the cable clamp shown in FIG. 1.

FIG. 8 is a cross-sectional view of the insert 108 positioned within the cable clamp housing 118. The aperture 138 of the upper housing 124 includes a flange 200. The coupling mechanism 184 of the insert is positioned within the aperture 138 so that the flange 186 of the coupling mechanism 184 engages the flange 200 of the aperture 138. The flanges 186 and 200 are engaged to secure the insert 108 within the upper housing 124. The aperture 140 of the lower housing 126 includes a flange 202. The coupling mechanism 194 of the insert 108 is positioned within the aperture 140 so that the flange 196 engages the flange 202 of the aperture 140. The flanges 196 and 202 are engaged to secure the insert 108 to the lower housing 126.

An edge 240 of the upper housing 124 abuts and extends along the engagement surface 226 of the insert 108. The edge 240 of the upper housing 124 abuts the second portion 222 of each rib 220. The edge 240 is secured between the coupling mechanism 184 and the second portion 222 of each rib 220 to secure the insert 108 to the upper housing 124. An edge 242 of the lower housing 126 abuts and extends along the engagement surface 236 of the insert 108. The edge 242 of the lower housing 126 abuts the second portion 232 of each rib 230. The edge 242 is secured between the coupling mechanism 194 and the second portion 232 of each rib 230 to secure the insert 108 to the lower housing 126.

During assembly of the connector 100, the cable clamp housing 118 is moved into the pre-assembled position 121, wherein the crossbar 152 of the engagement mechanism 144 engages the first latch 148 of the latching mechanism 146. In the pre-assembled position 121, the inserts 108 are positioned within the cable clamp housing 118. At least one of the coupling mechanisms 184 or 194 of each insert 108 is secured to the respective aperture 138 or 140. For example, each insert 108 may be secured to the upper housing 124 by securing the coupling mechanisms 184 in the apertures 138. Alternatively, each insert 108 may be secured to the lower housing 126 by securing the coupling mechanisms 194 in the apertures 140. The inserts 108 are secured to one of the upper housing 124 or the lower housing 126 when the cable clamp housing 118 is in the pre-assembled position 121.

In the pre-assembled position 121, the contacts 116 installed on wires 114 of the cable 106 are secured into the inserts 108. The cable clamp housing 118 is then moved to the assembled position 170, wherein the crossbar 152 of the engagement mechanism 144 engages the second latch 150 of the latching mechanism 146. In the assembled position 170, the coupling mechanisms 184 are secured in the apertures 138 and the coupling mechanisms 194 are secured in the apertures 140. In the assembled position 170, the inserts 108 are secured to both the upper housing 124 and the lower housing 126. Additionally, in the assembled position 170, the latches 176 and 178 engage one another to secure the upper housing 124 to the lower housing 126.

Figure 9:
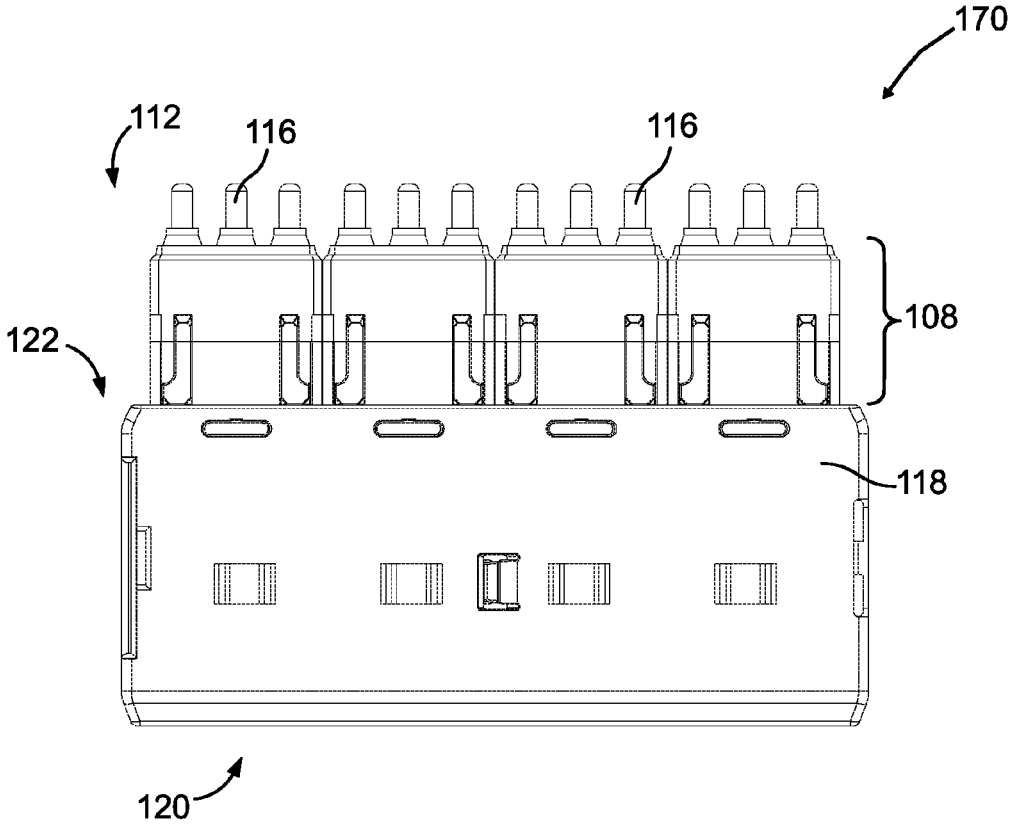
FIG. 9 is a top perspective view of the cable clamp shown in FIG. 1 and having the inserts shown in FIG. 1 positioned therein.

FIG. 9 is a top perspective view of the cable clamp housing 118 having the inserts 108 positioned therein in the assembled position 170. The cable 106 (shown in FIG. 1) is secured in the cable end 120 of the cable clamp housing 118. The wire end 110 of each insert 108 is secured within the mating end 122 of the cable clamp housing 118. The mating end 112 of each insert 108 extends from the mating end 122 of the cable clamp housing 118. The contacts 116 extend from the mating end 122 of the cable clamp housing 118. The contacts 116 are configured to engage a corresponding mating connector. In one embodiment, the inserts 108 are modular. Accordingly, the cable clamp housing 118 can be removed and replaced so that the inserts 108 can be serviced or replaced. In one embodiment, the inserts 108 are replaceable with other inserts 108 having different contact 116 configurations.

In the assembled position 170, the backshell 136 (shown in FIG. 1) is slid over the cable end 120 of the cable clamp housing 118. The shell 130 (shown in FIG. 1) is then positioned on the mating end 122 of the cable clamp housing 118. The shell 130 is configured to cover a portion of the backshell 136.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A connector for a cable comprising:

a cable clamp having a cable end and a mating end, the cable end configured to secure a cable, the cable clamp having an upper housing and a lower housing joined to the upper housing, the upper housing and the lower housing each having a front edge at the mating end, an aperture formed in at least one of the upper housing or the lower housing, an edge portion being defined between the aperture and the corresponding front edge, the upper housing and the lower housing being secured together in each of, and moveable between, a pre-assembled position and an assembled position; and an insert having a wire end and a mating end, the wire end configured to join to wires of the cable and the mating end configured to engage another connector, the mating end extending forward of the mating end of the cable clamp, the insert having a tab and a rib extending outward from a common side of the insert, the tab being received in and engaging the aperture, wherein the edge portion is captured and tightly held between the tab and the rib to secure the insert within the mating end of the cable clamp in the pre-assembled position, the upper housing and the lower housing moveable to the assembled position to retain the insert within the mating end of the cable clamp and the cable within the cable end of the cable clamp.

2. The connector of claim 1, wherein the insert includes a top having a top tab and a bottom having a bottom tab, the top tab configured to position in an aperture of the upper housing and the bottom tab configured to position in an aperture of the lower housing in the assembled position.

3. The connector of claim 1, the upper and lower housings each having apertures, the insert includes a top having a top tab and a bottom having a bottom tab, wherein the top tab is positioned in the aperture of the upper housing in the pre-assembled position to partially retain the insert in the cable clamp and the bottom tab is not positioned in the aperture of the lower housing in the pre-assembled position, and wherein both the top and bottom tabs are positioned in the corresponding apertures in the upper and lower housings in the assembled position.

4. The connector of claim 1, wherein the upper housing and the lower housing include corresponding latches interior of the cable clamp, the latches being positioned between the insert and a second insert held within the cable clamp, the latches being unlatched in the pre-assembled position and being configured to engage one another in the assembled position.

5. The connector of claim 1, wherein one of the upper housing or the lower housing includes a latching mechanism and the other of the upper housing and the lower housing includes an engagement mechanism, the latching mechanism having a first latch and a second latch, the engagement mechanism engaging the first latch in the pre-assembled position and the engagement mechanism engaging the second latch in the assembled position.

6. The connector of claim 1, wherein the mating end of the insert includes contacts configured to engage corresponding contacts of the other connector, the insert being modular so that the insert is replaceable with another insert having different contacts.

7. The connector of claim 1, wherein a detent is positioned on the wire end of the insert.

8. The connector of claim 1, wherein the insert is configured to be loaded into the cable clamp when the upper and lower housings are joined together in the pre-assembled position.

9. A connector for a cable comprising:

a cable clamp having a cable end and a mating end, the cable end configured to secure a cable, the cable clamp having an upper housing and a lower housing joined to the upper housing, the upper housing and the lower housing moveable between a pre-assembled position and an assembled position in a latching direction;

an insert having a wire end and a mating end, the wire end configured to join to wires of the cable and the mating end configured to engage another connector, the insert having a coupling mechanism configured to engage at least one of the upper housing or the lower housing to secure the insert within the mating end of the cable clamp in the pre-assembled position, the upper housing and the lower housing moveable to the assembled position to retain the insert within the mating end of the cable clamp and the cable within the cable end of the cable clamp; and a latching mechanism formed on one of the upper housing or the lower housing and an engagement mechanism fanned on the other of the upper housing and the lower housing, the latching mechanism having a staged latching arrangement comprising a first latch and a second latch offset in the latching direction, wherein in the pre-assembled position, the engagement mechanism engages the first latch to secure the upper and lower housings in the pre-assembled position and in the assembled position, the engagement mechanism engages the second latch to secure the upper and lower housings in the assembled position.

10. The connector of claim 9, wherein the insert includes a top having a top coupling mechanism and a bottom having a bottom coupling mechanism, the top coupling mechanism engaging the upper housing and the bottom coupling mechanism engaging the lower housing in the assembled position,

11. The connector of claim 9, the upper and lower housings each having apertures, the insert includes a top having a top coupling mechanism and a bottom having a bottom coupling mechanism, wherein the top coupling mechanism engages the upper housing in the pre-assembled position to partially retain the insert in the cable clamp and the bottom coupling mechanism does not engage the lower housing in the pre-assembled position, and wherein both the top and bottom coupling mechanisms engage the upper and lower housings in the assembled position.

12. The connector of claim 9, wherein the upper housing and the lower housing include corresponding latches interior of the cable clamp, the latches being positioned between the insert and a second insert held within the cable clamp, the latches being unlatched in the pre-assembled position and being configured to engage one another in the assembled position.

13. The connector of claim 9, wherein the wire end of the insert is positioned within the cable clamp and the mating end of the insert extends from the cable clamp.

14. The connector of claim 9, wherein a first recess is formed between the first latch and the second latch and a second recess is formed below the second latch, the engagement mechanism comprising a crossbar received in the first recess and engaging the first latch in the pre-assembled position and the crossbar received in the second recess and engaging the second latch in the assembled position.

15. The connector of claim 9, wherein the upper housing and the lower housing each having a front edge at the mating end, an aperture formed in at least one of the upper housing or the lower housing, an edge portion being defined between the aperture and the corresponding front edge, and wherein the mating end of the insert extends forward of the mating end of the cable clamp, the insert having a rib extending outward therefrom proximate to and spaced apart from the coupling mechanism, the coupling mechanism being received in and engaging the aperture, wherein the edge portion is captured and tightly held between the coupling mechanism and the rib to secure the insert within the mating end of the cable clamp in the pre-assembled position.

16. A connector for a cable comprising:

a cable clamp having a cable end and a mating end, the cable end configured to secure a cable, the cable clamp having an upper housing and a lower housing joined to the upper housing, the upper housing and the lower housing moveable between a pre-assembled position and an assembled position in a latching direction;

a latching mechanism formed on one of the upper housing or the lower housing and an engagement mechanism formed on the other of the upper housing and the lower housing, the latching mechanism having a staged latching arrangement comprising a first latch and a second latch offset in the latching direction, the engagement mechanism engaging the first latch in the pre-assembled position to secure the upper and lower housings in the pre-assembled position, and the engagement mechanism engaging the second latch in the assembled position to secure the upper and lower housings in the assembled position; and an insert having a wire end and a mating end, the wire end of the insert positioned within the cable clamp and the mating end of the insert extending from the cable clamp.

17. The connector of claim 16, wherein the insert includes a top having a top coupling mechanism and a bottom having a bottom coupling mechanism, the top coupling mechanism engaging the upper housing and the bottom coupling mechanism engaging the lower housing in the assembled position.

18. The connector of claim 16, the upper and lower housings each having apertures, the insert includes a top having a top coupling mechanism and a bottom having a bottom coupling mechanism, wherein the top coupling mechanism engages the upper housing in the pre-assembled position to partially retain the insert in the cable clamp and the bottom coupling mechanism does not engage the lower housing in the pre-assembled position, and wherein both the top and bottom coupling mechanisms engage the upper and lower housings in the assembled position.

19. The connector of claim 16, wherein a first recess is formed between the first latch and the second latch and a second recess is formed below the second latch, the engagement mechanism comprising a crossbar received in the first recess and engaging the first latch in the pre-assembled position and the crossbar received in the second recess and engaging the second latch in the assembled position.

20. The connector of claim 16, wherein the upper housing and the lower housing each having a front edge at the mating end, an aperture formed in at least one of the upper housing or the lower housing, an edge portion being defined between the aperture and the corresponding front edge, and wherein the mating end of the insert extends forward of the mating end of the cable clamp, the insert having a tab and a rib extending outward therefrom, the tab being received in and engaging the aperture, wherein the edge portion is captured and tightly held between the tab and the rib to secure the insert within the mating end of the cable clamp in the pre-assembled position.

* * * * *